US007484731B2

(12) United States Patent
Gutierrez-Vazquez et al.

(10) Patent No.: US 7,484,731 B2
(45) Date of Patent: Feb. 3, 2009

(54) PRINTING DEVICE AND METHOD

(75) Inventors: Hernan Ildefonso Gutierrez-Vazquez, Boxde, ID (US); Dave Bettineski, Vancouver, WA (US); Jon Johnson, Vancouver, WA (US); Jeetendra Kumar, Boise, ID (US); Nataraj Kumar Gobbak, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 219 days.

(21) Appl. No.: 11/510,919

(22) Filed: Aug. 28, 2006

(65) Prior Publication Data

US 2008/0048390 A1 Feb. 28, 2008

(51) Int. Cl.
*B65H 7/02* (2006.01)

(52) U.S. Cl. ..... 271/258.04; 271/256; 271/259; 271/258.02; 271/258.01; 270/58.02; 270/58.09; 270/58.03

(58) Field of Classification Search ..... 271/256, 271/259, 258.02, 258.01, 258.04; 270/58.02, 270/58.09, 58.03
See application file for complete search history.

(56) References Cited

U.S. PATENT DOCUMENTS 4,231,567 A * 11/1980 Ziehm ..... 271/259
4,727,398 A * 2/1988 Honjo et al. ..... 399/374
4,757,984 A * 7/1988 Rowe et al. ..... 270/58.03
4,786,041 A * 11/1988 Acquaviva et al. ..... 271/3.13
4,811,049 A * 3/1989 Honjo et al. ..... 399/374
4,881,104 A * 11/1989 Kusumoto et al. ..... 399/18
5,190,274 A * 3/1993 Kamamoto et al. ..... 270/58.09
5,531,435 A * 7/1996 Momose ..... 271/258.03
5,618,037 A * 4/1997 Chang et al. ..... 271/258.02
5,651,542 A * 7/1997 Yamauchi et al. ..... 271/122
5,678,123 A * 10/1997 Kim ..... 399/21
5,781,825 A * 7/1998 Okamoto ..... 399/17
5,815,766 A * 9/1998 Miller et al. ..... 399/21
5,852,765 A * 12/1998 Yamashita et al. ..... 399/407
6,690,476 B1 * 2/2004 Hren ..... 358/1.12
6,744,998 B2 6/2004 McIntyre
7,092,646 B2 8/2006 Schroath et al.
2004/0178562 A1 * 9/2004 Graef et al. ..... 271/119
2006/0006594 A1 * 1/2006 Kuru et al. ..... 271/258.02
2006/0145414 A1 * 7/2006 Yokobori et al. ..... 271/258.01
2007/0114716 A1 * 5/2007 Morikawa et al. ..... 271/258.01

FOREIGN PATENT DOCUMENTS

JP H11-334181 12/1999

* cited by examiner

*Primary Examiner*—Patrick H Mackey
*Assistant Examiner*—Prasad V Gokhale

(57) ABSTRACT

A device and method for assisting a user to clear a media jam in a printing device that announces pages, picks media responsively to the announced pages and images the picked media using a media transport path, that: detects a media jam at a given location along the media transport path; halts printing device components upstream from the given location in the media path while continuing to image picked media downstream from the given location in the media transport path; and, prompts the user to clear the detected media jam from the given location after all downstream media has been imaged.

18 Claims, 15 Drawing Sheets

PRINTING DEVICE AND METHOD

FIELD OF THE INVENTION

The present invention relates to printing devices and methods. More particularly, the present invention relates to printing devices having media jam indicators and to methods for resolving printable media jams.

BACKGROUND OF THE INVENTION

Printable media jams, or jams, occur in printing devices or printers, such as laser printers, color printers, facsimile machines, photocopiers and combination devices having print capabilities. Jams often prove difficult to find and remedy, as jams may occur at various locations along printable media paths of printing devices. The printable media typically takes the form of printable substrates, such as paper or plastic substrates. Approaches to dealing with a jam typically only advise that a jam has occurred. In some cases, the printer will provide a single indication of a general area of the media jam. In other instances, detailed instructions for locating and clearing areas where jams typically occur may be disposed on the inside front door of the printing device, or may be included in a user's guide or on-line manual.

Typically, once a media jam is detected, all media in the media path as stopped. Once the media is stopped, a media jam message is provided. Once the user has finished the steps needed to clear the jam condition, the printing device goes through a path checking process and detects other areas where media needs to be removed to resume printing. The user needs to follow these steps until all the media in the paper path is removed.

Alternative mechanisms for enabling a user to locate and resolve media jams are desired.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts and.

DETAILED DESCRIPTION OF THE PREFERRED EMBODIMENTS

The following description of the preferred embodiments is merely by way of example and is in no way intended to limit the invention, its application, or uses.

Figure 1:
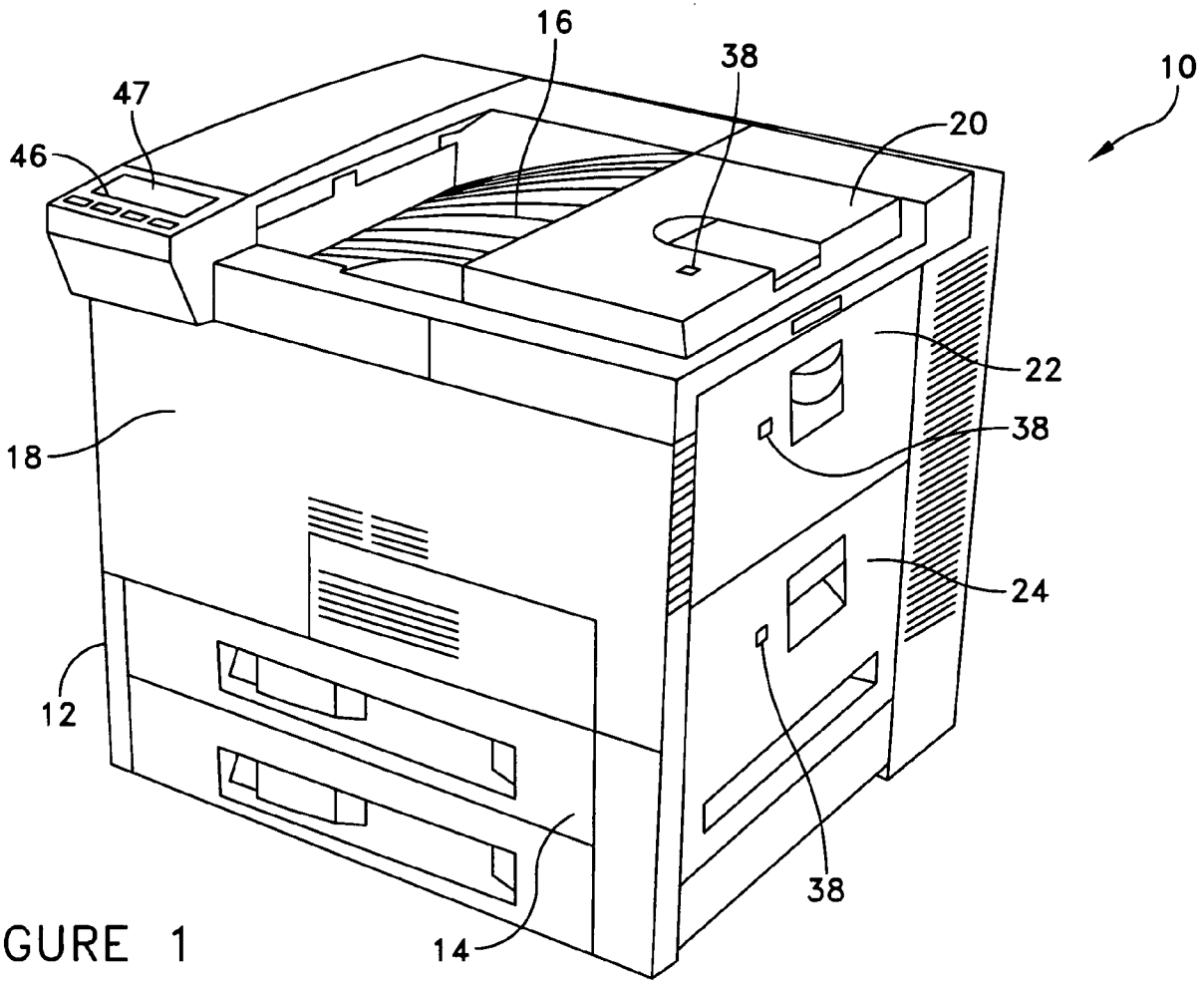
FIG. 1 shows a perspective view of a printing device according to an embodiment of the present invention.

FIG. 1 shows a perspective view of an exemplary printing device 10 in accordance with an embodiment of the present invention. The illustrated printing device 10 takes the form of a table-top printer, and will be referred to as a printer for discussion purposes only. The illustrated printer 10 is a laser type printer. It will be appreciated however, that other types of printers and printing devices, such as an inkjet printer, a large format printer, copier or a combination printer, scanner, copier, fax or the like, may similarly be realized.

Printer 10 includes a housing 12. Printer 10 includes at least one feed tray 14, from where media to be printed, e.g., printable media, is stored and fed, or picked from, into printer 10. In the illustrated case, the media takes the form of sheets of paper. But other media, such as transparencies, envelopes, post cards, photo media and the like, may also be used.

Printer 10 includes an output tray 16 for receiving printed media. Printer 10 also includes one or more access doors 18, 20, 22, 24. The embodiment of FIG. 1 shows four access doors 18, 20, 22, 24, but other numbers and configurations of doors may be used. In the illustrated embodiment front access door 18 provides access to the interior of the front area of the housing 12; top access door 20 allows access to the top area of the housing 12; and upper and lower side access doors 22, 24 allow access to different areas within the housing 12, near a side thereof.

Printer 10 includes a user interface 46. While the illustrated user interface 46 includes four (4) buttons and a display 47, other configurations can be used.

Figure 2:
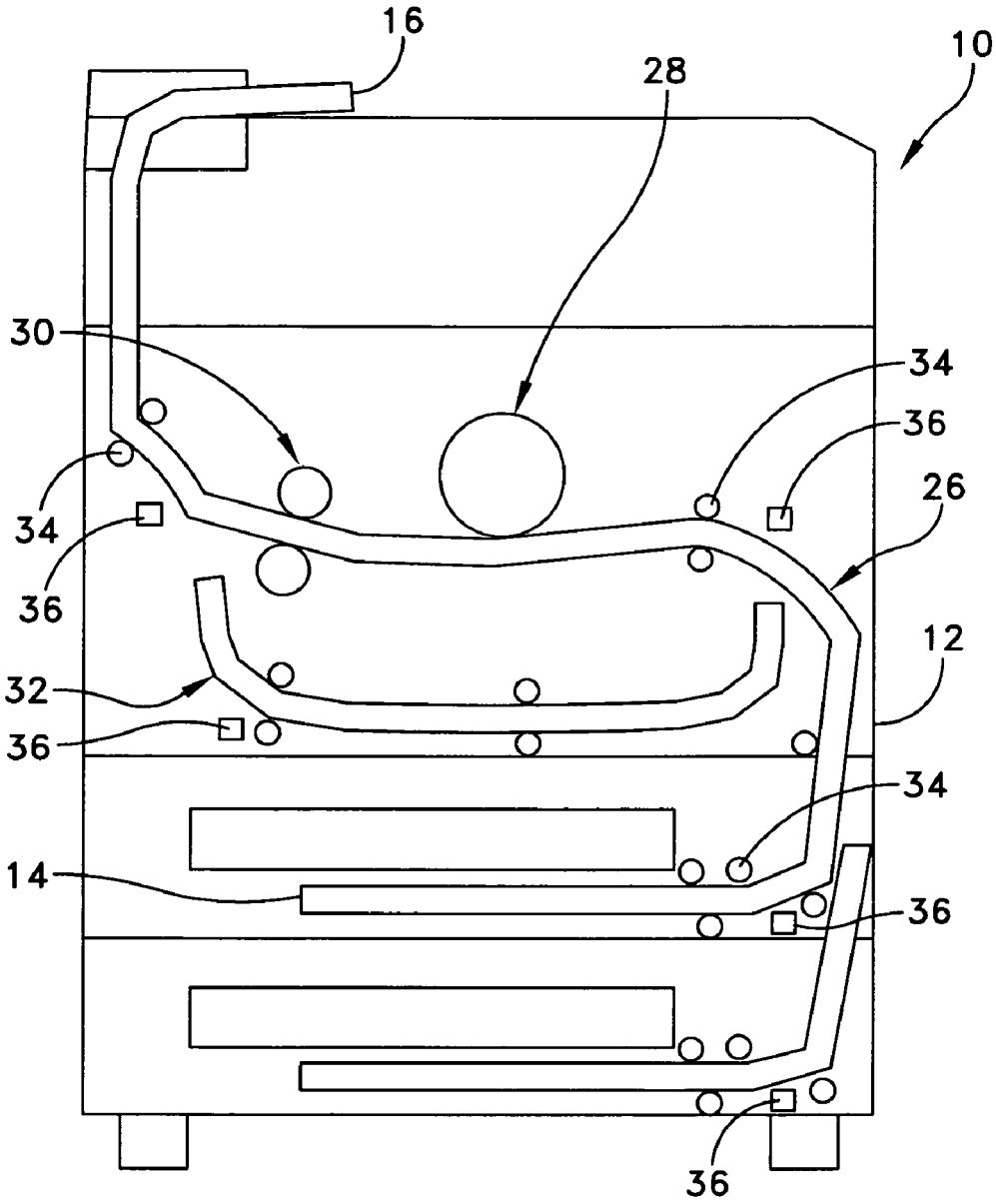
FIG. 2 shows a plan view of a media path corresponding to the printing device of FIG. 1 according to an embodiment of the present invention.

Referring now also to FIG. 2, it shows a plan view of an exemplary media path 26 for moving printable media through printer 10 in accordance with an embodiment of the present invention. In the illustrated case, printable media moves from tray 14 and through housing 12 along a paper path generally indicated at 26. The media travels to a drum unit 28, where toner is applied to it. The media then travels to a fuser assembly 30, where the applied toner is fused to the media. Thereafter, the media moves to output tray 16. A duplexing path 32, which is an alternative media path, allows for printing two opposing sides or surfaces of the media. An output device, such as a stapler, collator or finisher may be coupled to housing 12, such that it forms a part of the media path 26.

Rollers 34 move picked media along or through media path 26. One or more of the rollers 34 are coupled to a drive motor (not shown) to impart movement thereto. As the media travels along media path 26 it may become jammed. Jams are detected by printable media jam sensors 36 associated with media path 26. Any suitable number of and type jam sensor can be used within the context of the illustrated embodiment.

Figure 3:
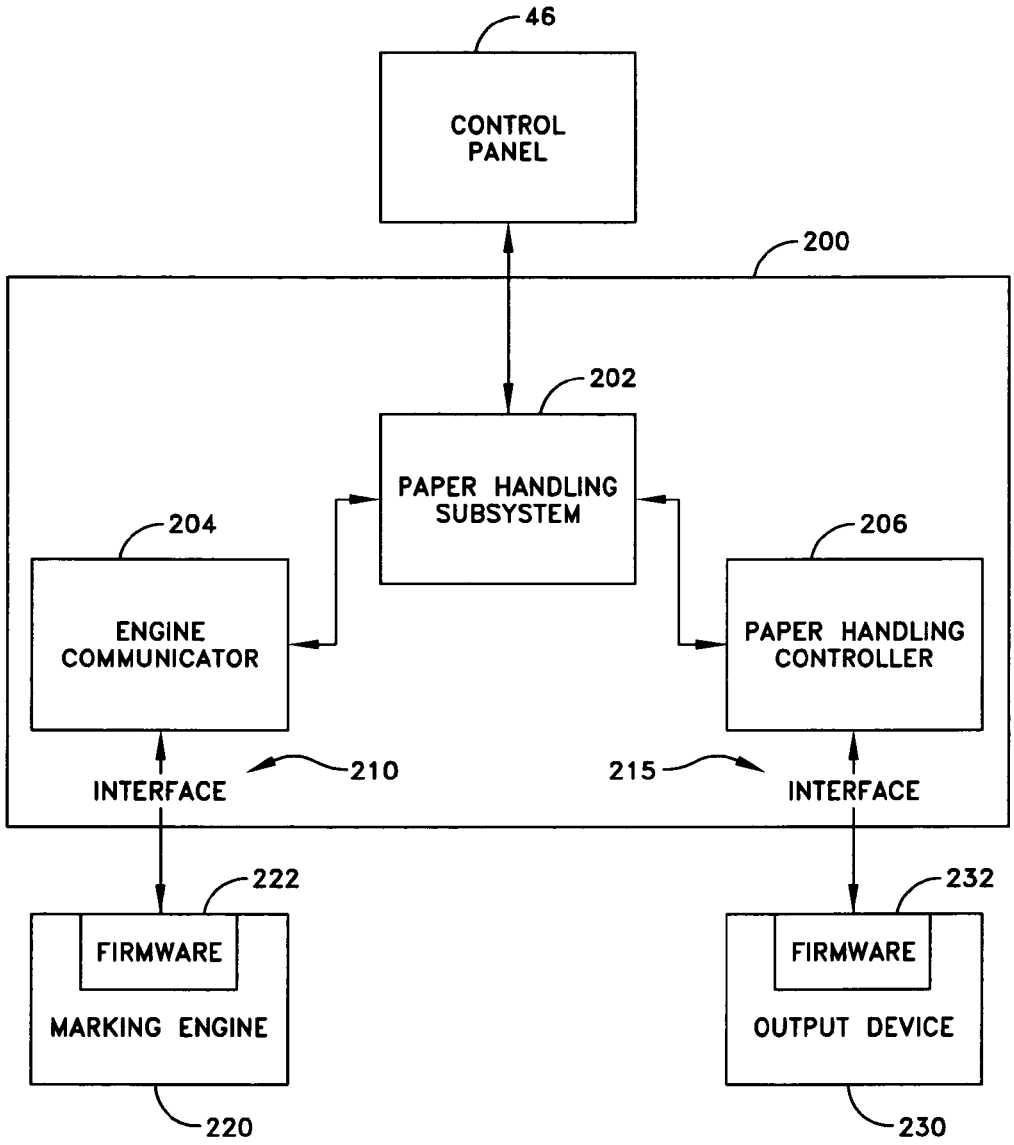
FIG. 3 shows a block diagram of select printer components according to an embodiment of the present invention.

Referring now to FIG. 3, there is shown a block diagram of select printer 10 components according to an embodiment of the present invention. In the illustrated case, printer 10 includes a formatter 200, marking engine 220 and output device 230. By way of non-limiting example, in the illustrated case of FIGS. 1 and 2, marking engine 220 includes drum unit 20, fuser assembly 30, rollers 34 and sensors 36. In such a case, output device 230 may take the form of a stapler, sorter or finisher, for example.

According to an embodiment of the present invention, formatter 200 may be housed by housing 12 (FIG. 1) and take the form of firmware, although Application Specific Integrated Circuits (ASICs) or software only implementations may also be used. Firmware is generally a combination of software and hardware. The hardware component typically includes a processor. "Processor", as used herein, refers generally to a computing device including a Central Processing Unit (CPU), such as a microprocessor. A CPU generally includes an arithmetic logic unit (ALU), which performs arithmetic and logical operations, and a control unit, which extracts instructions (e.g., a computer program or software incorporating code) from memory and decodes and executes the instructions, calling on the ALU when necessary. "Memory", as used herein, refers generally to one or more devices capable of storing data, such as in the form of chips, tapes, disks or drives. Memory may take the form of one or more random-access memory (RAM), read-only memory (ROM), programmable read-only memory (PROM), erasable programmable read-only memory (EPROM), or electrically erasable programmable read-only memory (EEPROM) chips, by way of example only. Memory may take the form of a hard disk or a CD-ROM, by way of further example. Memory may be internal or external to an integrated unit, e.g. an integrated circuit (IC), including a processor. The software component of firmware is typically written into non-volatile memory, such as ROMs, PROMs and EPROMs.

In the illustrated case of FIG. 3, formatter 200 includes paper handling subsystem 202. Subsystem 200 also includes an engine communicator 204 and paper handling controller 206 being operatively coupled to subsystem 202, such as via one or more buses or dedicated connections. Subsystem 202 may also be coupled to interface (e.g., control panel) 46 (FIG. 1), such as via a bus or dedicated connection. Formatter 200 may include other subsystems as well, such as an input/output (I/O) subsystem, job subsystem, personality/language subsystem and/or rendering or video subsystem, for example.

Referring still to FIG. 3, marking engine 220 and output device 230 each also include firmware 222, 232, respectively. Firmware 222 is operatively coupled to engine communicator 204 via interface 210. Interface 210 may take the form of a bus or dedicated connection. Firmware 232 is operatively coupled to controller 206 via interface 215. Interface 210 may take the form of a bus or dedicated connection, such as a Jet-Link connection. Firmware 222 controls operation of engine 200 and communicates with subsystem 202. Firmware 232 controls operation of device 230 and also communicates with subsystem 202. While FIG. 3 illustrates a single formatter 200, marking engine 220 and output device 230, other configurations may be used.

Figure 4:
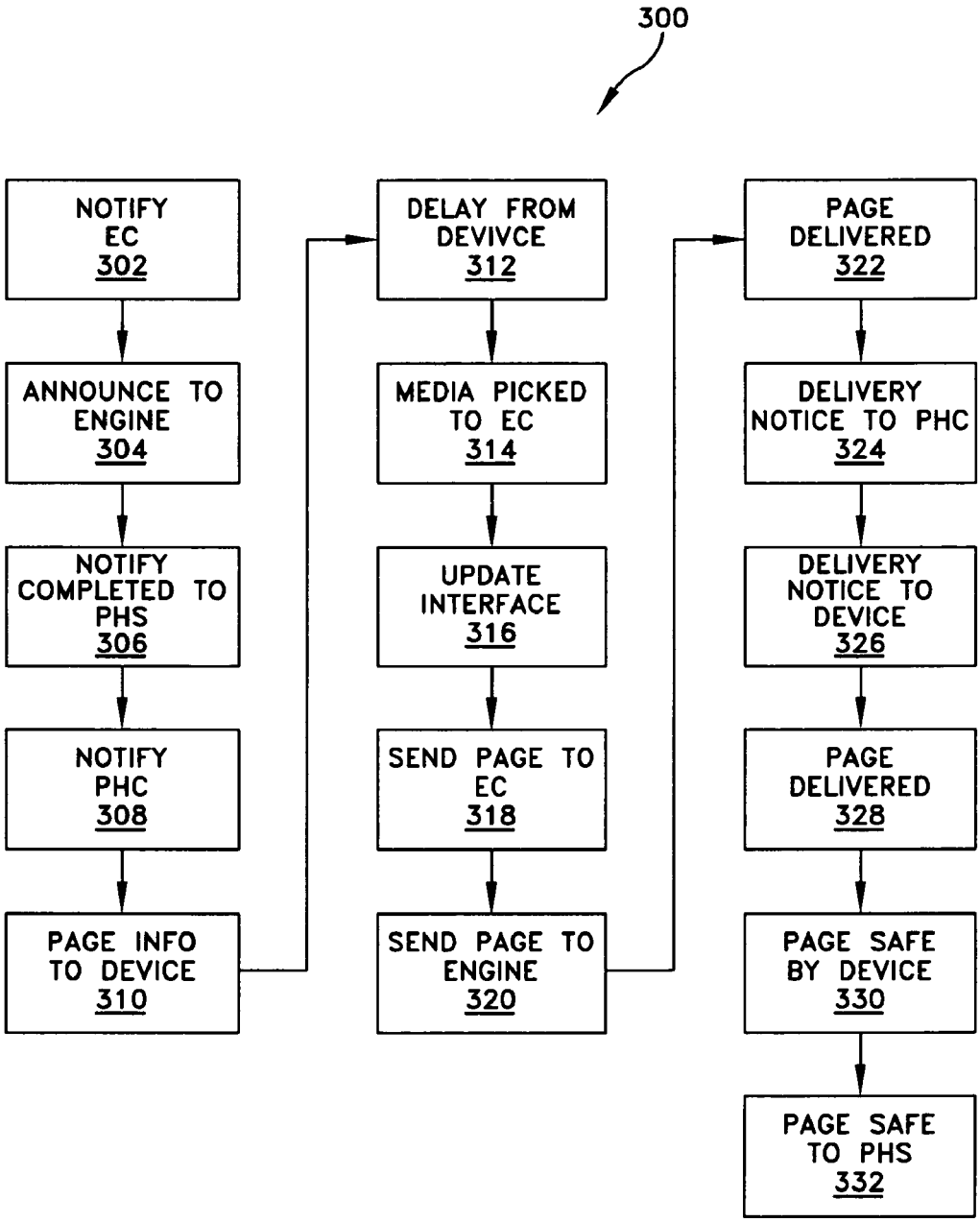
FIG. 4 shows a flow diagram of a process suitable for use with the printer configuration of FIG. 3 according to an embodiment of the present invention.

Referring now also to FIG. 4, there is shown a process 300 suitable for use with the printer 10 configuration of FIG. 3 according to an embodiment of the present invention. Process 300 commences after a print job is received and parsed. The print job may be received from a personal computer operatively connected to printer 10 (FIG. 1) via a parallel port, network or other data communicating connection. It should be understood, however, that the print job may emanate from a copy or facsimile function, where printer 10 takes the form of a multi-function printing device. Process 300 illustrates exemplary steps for a single page of a print job. According to an embodiment of the present invention, process 300 is repeated for each page of the print job, in a parallel fashion—such that process 300 for a second page of a given print job is commenced prior to completion of process 300 for a first page of the print job, and so on.

Referring still to FIG. 4, process 300 commences with paper handling subsystem (PHS) 202 notifying engine communicator (EC) 204 of a page of the print job at block 302. At block 304, EC 204 notifies engine firmware 222 of the page, i.e., announces the page. At block 306, EC 204 signals PHS 202 that engine 220 has been notified of the page. At block 308, PHS 202 notifies paper handling controller (PHC) 206 of the page. At block 310, information about the page that was parsed from the print job is provided to device firmware 232. At block 312, device firmware 232 provides information regarding the page, such as the amount of delay it will need before being able to process a next page of the print job, to PHC 206. At block 314, engine firmware 222 signals EC 204 that a media sheet for the page has been picked, e.g., was fed across an input tray.

At block 316, PHS 202 causes interface 46 to be updated, such as to display "Processing Job From Tray 1". At block 318, PHS 202 sends page imaging data to EC 204. At block 320, the raster page image data is sent to engine firmware 222, for use by engine 220. At block 322, engine firmware 222 notifies EC 204 that the page has been delivered, e.g., imaged. At block 324, EC 204 notifies PHC 206 that the page has been delivered. At block 326, PHC 206 notifies device firmware 232 that a page is being delivered. At block 328, EC 204 notifies PHS 202 that the page has been delivered.

At block 330, device firmware 232 notifies PHC 206 that the page has been safely delivered from device 230, e.g, into an output bin. And, at block 332 PHC 206 notifies PHS 202 that the page has been safely delivered by device 230.

Figure 5:
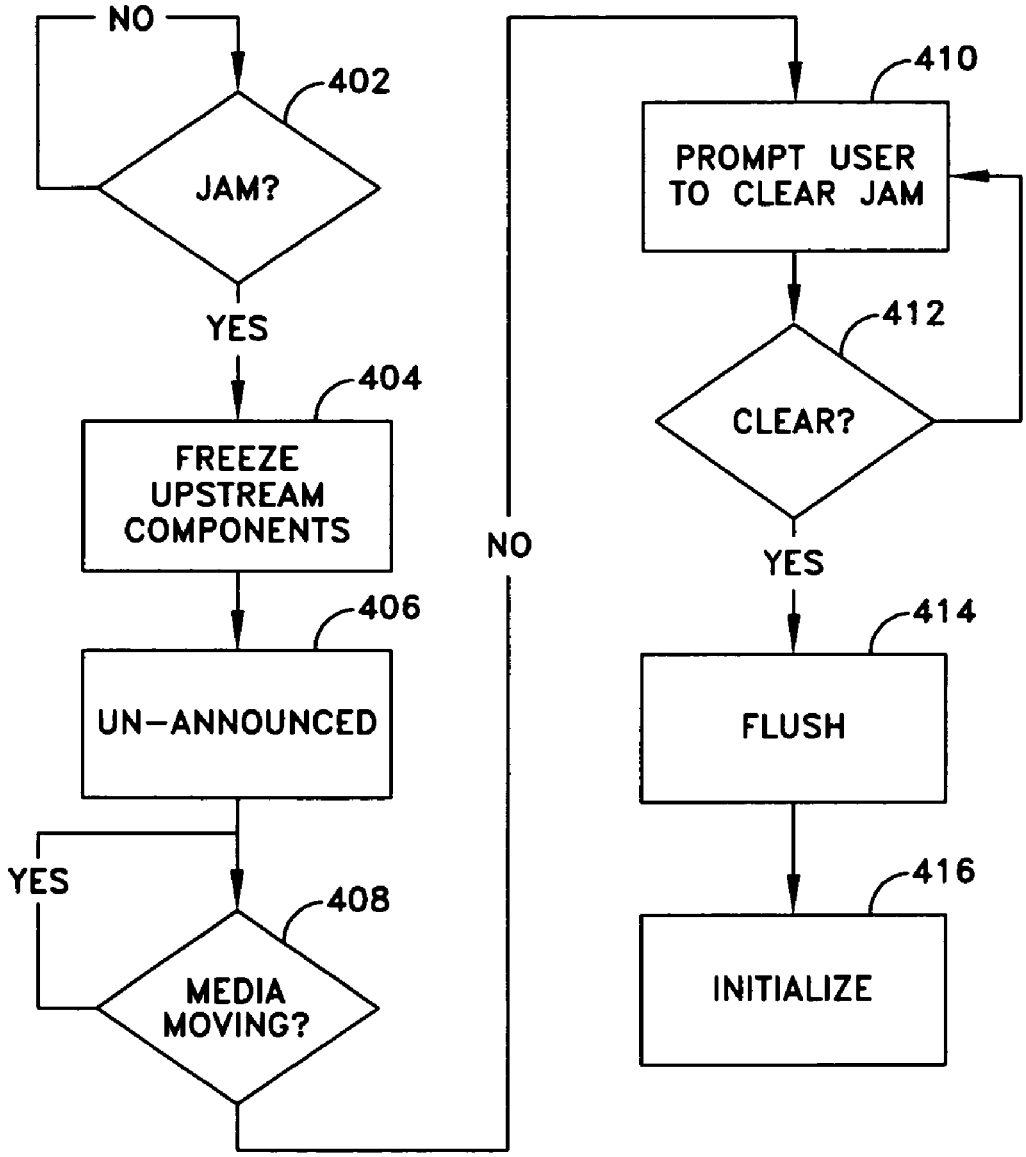
FIG. 5 shows a flow diagram of a jam resolution process according to an embodiment of the present invention.

As discussed, a page may jam while traversing the media path 26 of printer 10. Referring now also to FIG. 5, there is shown a jam resolution process 400 according to an embodiment of the present invention. In the illustrated case, when a media jam is detected at a given location (block 402), the printer halts printer components and media upstream of the given location, but continues to move media downstream from the given location and deliver them safely into a destination bin (block 404). The formatter stops notifying the marking engine of new pages (e.g., announcing pages) and starts unannouncing pages that have not yet been picked by the hardware (block 406). Once the downstream pages are delivered and no pages are moving in the media path (block 408), the formatter posts the jam message on the control panel and prompts a user to clear the jam (block 410). Once the user has cleared the jammed media (block 412), the formatter coordinates a flush sequence to flush or eject pages that are upstream from the jammed media (block 414). Thereafter, the printer is re-initialized (block 416).

According to an embodiment of the present invention, the engine firmware 222 and output device firmware 232 are operative to continue to operate portions of engine 220 and device 230 downstream from a detected jam, respectively. For example, engine 220 may include a plurality of jam sensors as discussed above. Upon one of the jam sensors indicating a jam condition within engine 220, firmware 222 may halt engine 220 components associated with and upstream from the position of the sensed jam. For example, firmware 222 may have stored in a memory associated therewith one or more look-up tables that identify components and their respective positions along a media path. When a jam is detected at a given location in the media path, firmware 222 identifies those components at and up-stream from the given location using the look-up tables and halts those components. For non-limiting purposes to completeness, those components down-stream from the given location may not be halted, such that their operation continues un-interrupted. Similarly, output device 230 may include jam sensors. Upon one of the jam sensors indicating a jam condition within device 230, firmware 232 may halt device 232 components associated with and up-stream from the position of the sensed jam.

Further, formatter 200 may halt other printer 10 components upstream from a sensed jam condition in either engine 220 or device 230. For example, upon detecting a jam in device 230, firmware 232 may communicate the jam condition to PHC 206. PHC 206 notifies PHS 202 of the sensed jam in device 220, which then instructs EC 204 to halt engine 220 using firmware 222 (block 404, FIG. 5). According to an embodiment of the present invention, however, firmware 222, 232 and PHS 202 allow components positioned downstream from a sensed jam condition to continue imaging and finishing media, until no moving media is sensed in either engine 220 or device 230 (block 408, FIG. 5)—upon which occurrence a user may be prompted to clear the sensed jam.

Once the jam is cleared, PHS 202, EC 204 and PHC 206 may initiate a flush sequence to start flushing remaining media that is upstream from the jammed media and that has not been cleared by the user. According to an embodiment of the present invention, PHS 202 coordinates between different sub-devices e.g, engine 220, device 230, to ensure the flush is successful. For example, relatively down stream components may begin flushing media prior to relatively upstream components, so as to reduce the likelihood of another jam during flushing (e.g., device 230 may begin flushing prior to engine 220). Once the media in the paper path is flushed (to a waste bin, for example), EC 204 and/or PHC 206 indicate the flush sequence is complete to PHS 202, and printer 10 is re-initialized, e.g., goes to the state "idle, ready". Printing the job that got jammed then resumes, optionally re-printing the pages that got picked but not finished dependently upon a jam recovery user setting.

Referring again to FIG. 5, process 400 includes prompting a user to clear a detected jam at block 410. Different people respond in different ways to different types of instruction (e.g., spatial instruction, visual instruction and audible instruction). These understandings may be applied to assist users to resolve media jams in printing devices. By way of explanation, people who are generally classified as spatial learners learn by doing. Spatial memory is responsible for recording information about one's environment and its spatial orientation. For example, a person's spatial memory is used to navigate around a familiar city. People who are generally classified as visual learners learn by seeing. For visual learners, pictures represent significant cues in the learning experience. And, people who are classified as audible learners learn by hearing, e.g., being told how to do something or receiving audible feedback for their actions. Thus, some people learn best from spatial experience or instructions, other people learn best from visual instruction, and still others learn best from audible instruction.

According to an embodiment of the present invention these understandings may be utilized to comprehensively assist all three learning types or classifications to resolve media jams in printing devices. For example, a combination of visual instruction, audible alerts, and spatial indications may be used to assist a user to resolve media jams in printing devices.

Once a jam is detected (block 402, FIG. 5), upstream components have been halted (block 409, FIG. 5), unpicked pages have been unannounced (block 406, FIG. 5) and no components are moving (block 408, FIG. 5), a series of sequential indications are provided to assist a user to resolve the jam. According to an embodiment of the present invention a plurality of indications of differing types is provided in accordance with a same resolution sequence. According to an embodiment of the present invention, a sequence of spatial indications, a sequence of visual instructions and a sequence of audible indications are provided to assist a user to resolve the detected media jam(s).

Spatial Indicators

Figure 6A:
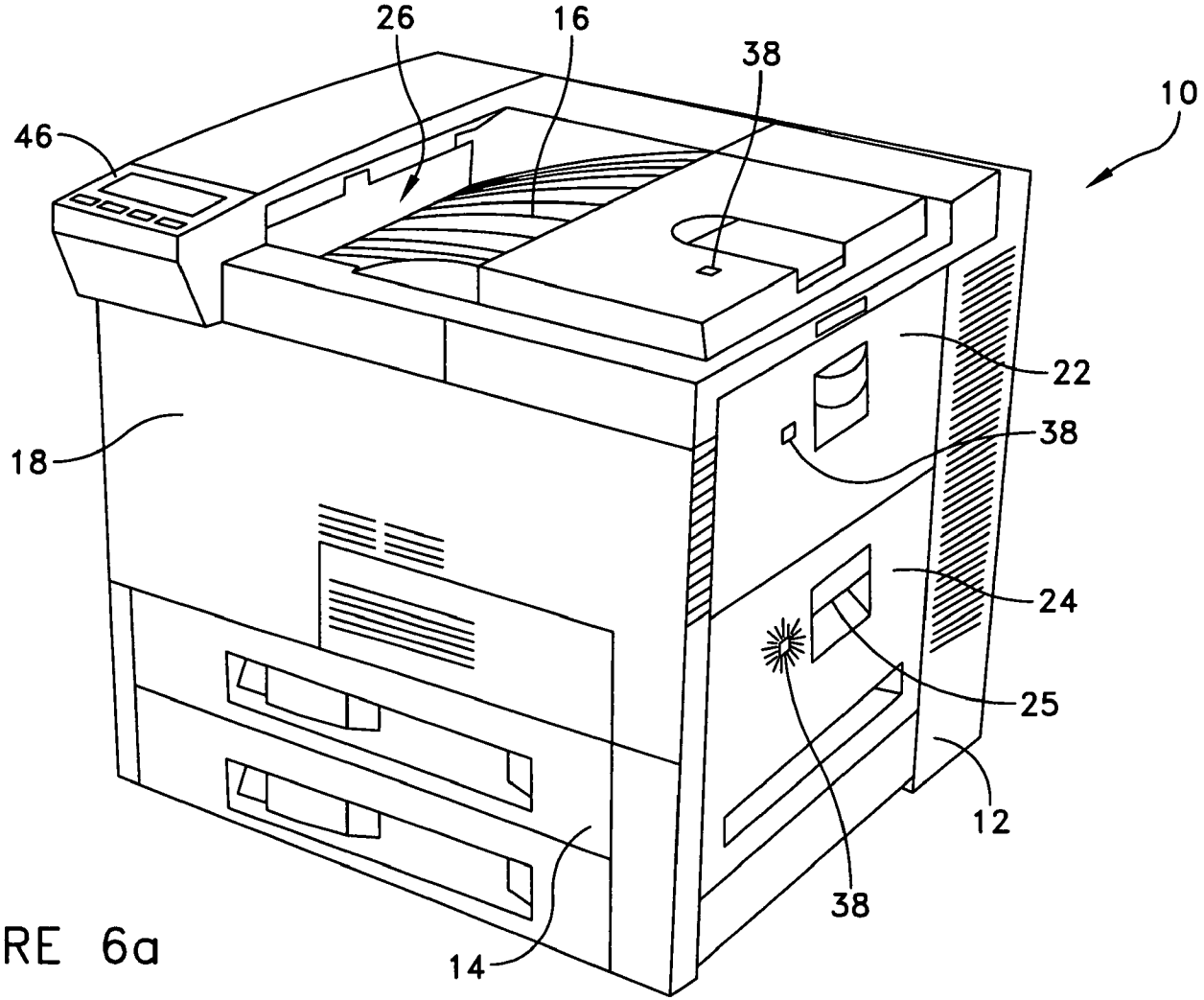
FIGS. 6*a* and 6*b* show perspective views of the printing device of FIG. 1 indicating a media jam at one location in the media path according to an embodiment of the present invention.
Figure 6B:
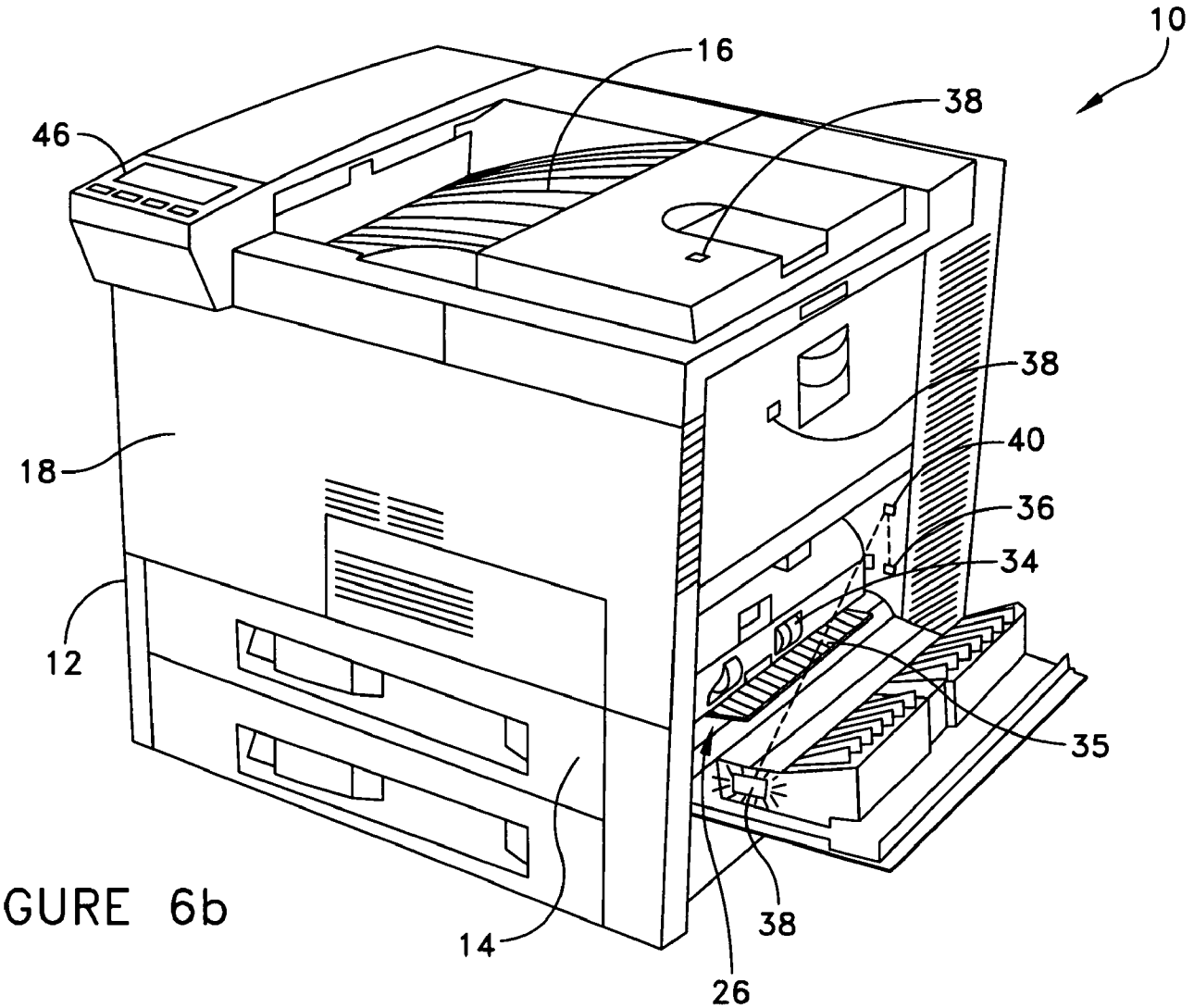
Figure 6C:
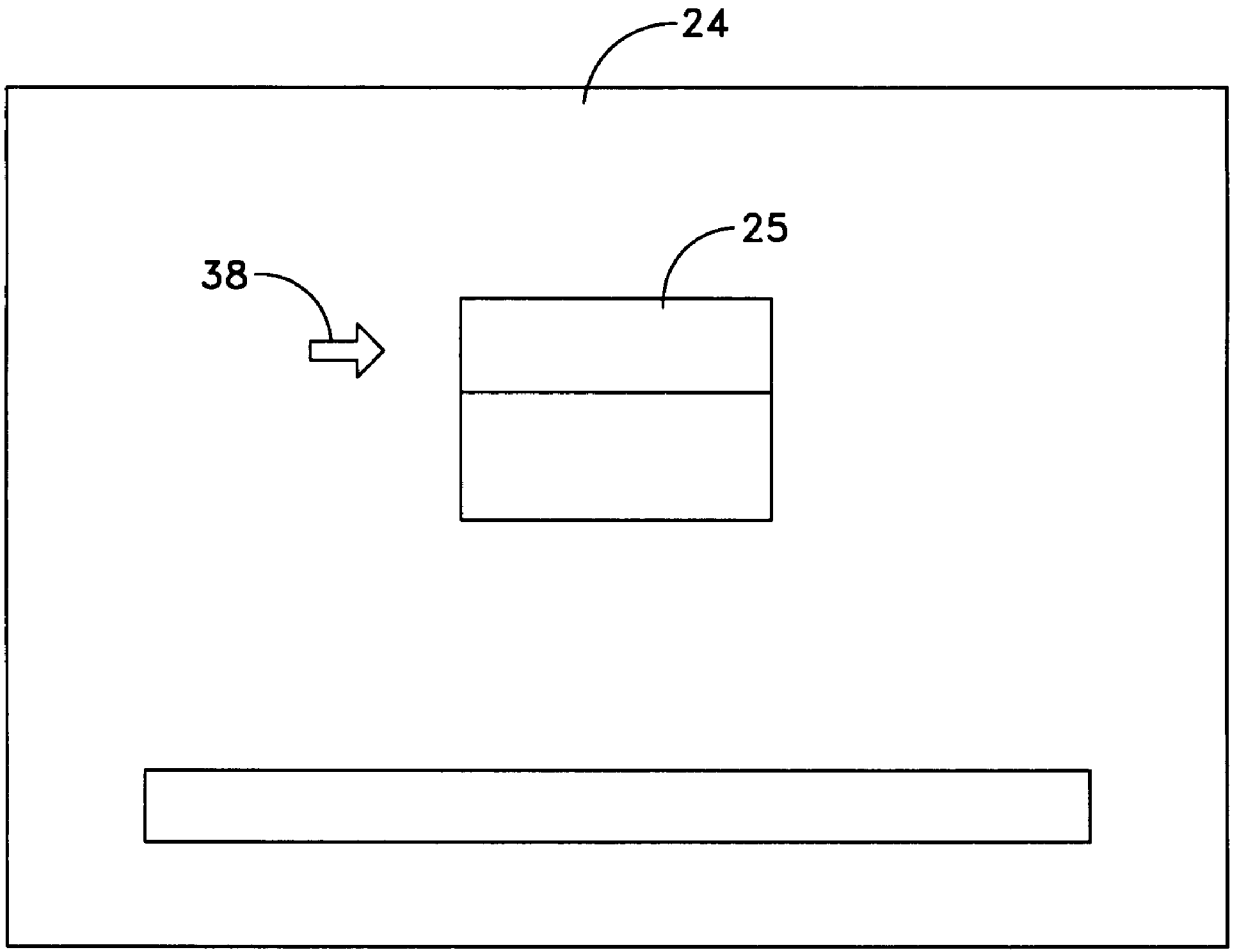
FIG. 6*c* shows a view of a lower-side door of the printing device of FIG. 1 according to an embodiment of the present invention.
Figure 7A:
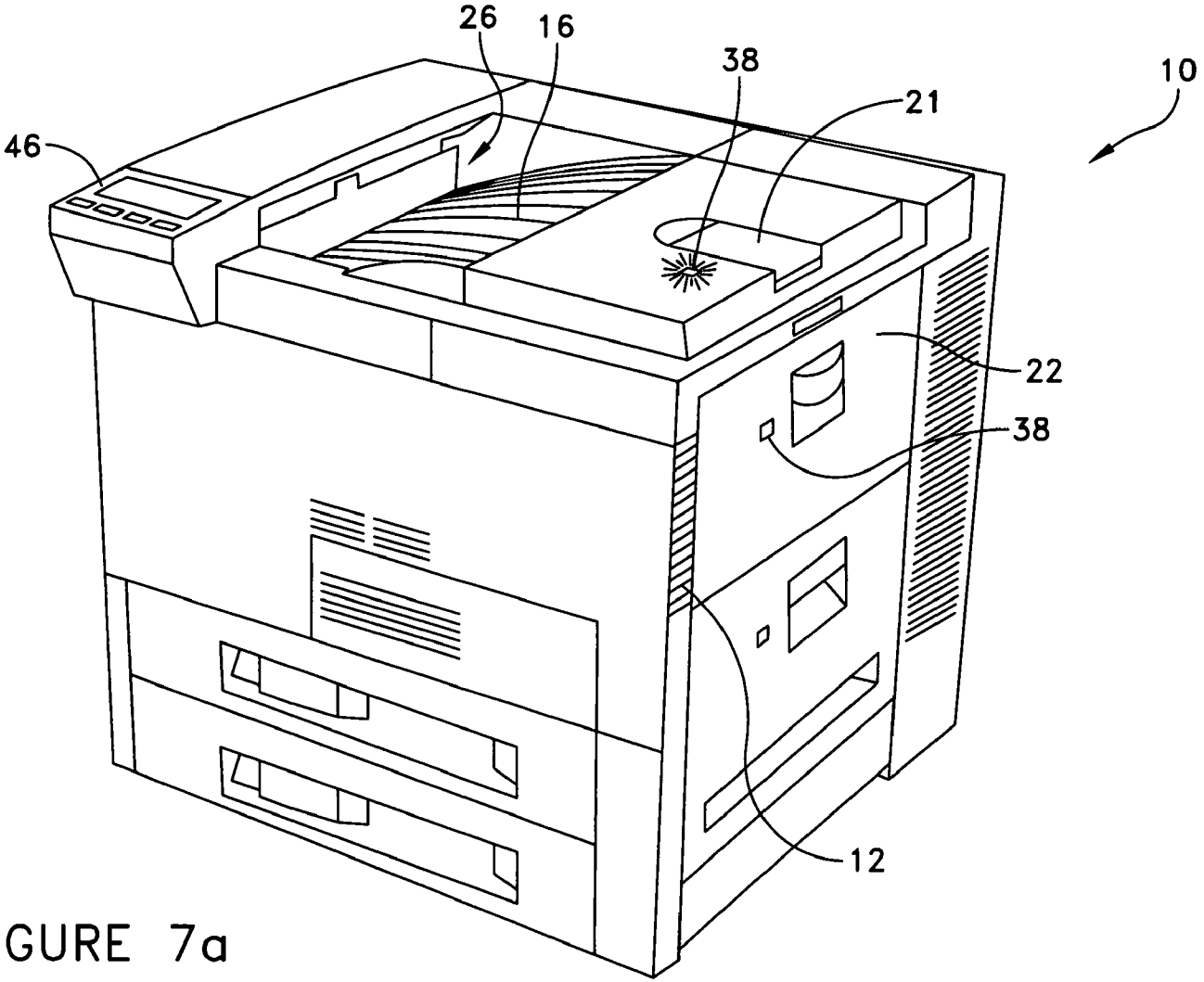
FIG. 7*a* shows a perspective view of the printing device of FIG. 1 indicating a media jam at another location in the media path according to an embodiment of the present invention.
Figure 7B:
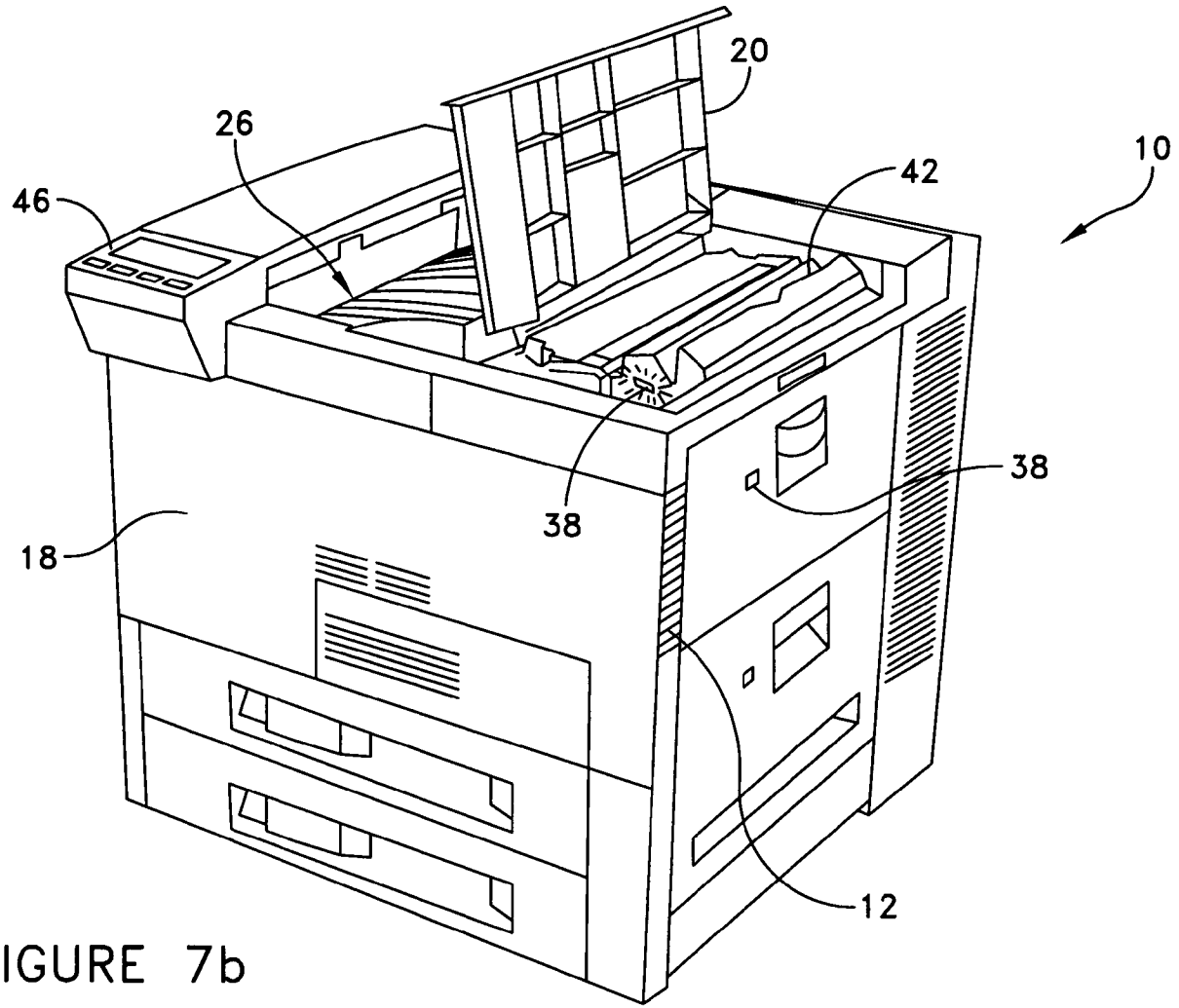
FIG. 7*b* shows a perspective view of the printing device of FIG. 4*a* indicating a next successive step necessary to locate the media jam according to an embodiment of the present invention.

FIGS. 6A and 6B show perspective views of the printer 10 of FIG. 1 indicating a media jam at one location in the media path. FIGS. 7A and 7B show perspective views of the printer 10 of FIG. 1 indicating a media jam at another location in the media path. Referring now to FIGS. 1, 2, and 6A-7B, printer 10 includes a plurality of spatial indicators 38. Each spatial indicator may selectively emit light. According to an embodiment of the present invention, each spatial indicator 38 may take the form of one or more light emitting diodes (LED's). Spatial indicators 38 can take other forms as well, such as a different kind of light emitting device, a mechanical tab that may be selectively positioned, or any other selectively activated indicator. Spatial indicators 38 provide spatial indications to assist users to resolve media jams detected by one or more of the sensors 36.

Spatial indicators 38 can be located adjacent a printer component adapted to be manipulated by a user, such as a door latch 25 (FIG. 6A) or lever. Additionally, or in lieu thereof, spatial indicators 38 can be located adjacent media path 26. For example, indicators 38 may be positioned along media path 26. Further, and referring now also to FIG. 6C, there is shown a view of lower side door 24 of printer 10. In the embodiment shown in FIG. 6E, spatial indicator 38 takes the form of a selectively illuminated arrow. According to an embodiment of the present invention, one or more of the indicators may point toward the printer component adapted to be manipulated by a user it is associated with, in the illustrated case of FIG. 6C latch 25. Such a directional indicator may be manufactured by masking a rectangular or circular indicator using an optically opaque material, for example. Of course, other techniques may be used as well. Such directional spatial indicators provide additional spatial indication as compared to rectangular indicators, for example and are particularly well suited for use where several user manipulable components are located within close proximity to one another.

According to an embodiment of the present invention, one or more of the indicators may be positioned to provide light in an otherwise dark area inside printer 10, housing 12. This may assist a user to find a piece of jammed media in these otherwise dark areas, thus further assisting a user with jam resolution. One such area is near drum 28 (FIG. 2), for example.

A processor 40 (shown schematically in FIG. 3B) is operatively coupled to sensors 36. Processor 40 can either be contained within printer 10 or incorporated into a computer or other drive associated with the printer 10. Processor 40 is programmed to selectively and sequentially activate ones of the indicators 38 responsively to a media jam being detected by at least one of the sensors 36 and according to a determined resolution sequence. According to an embodiment of the present invention, processor 40 functionality may be provided by formatter 200 PHS 202 (FIG. 3).

Spatial indicators 38 are sequentially activated to help the user identify the location of jammed media. An exemplary sequence associated with a media jam in a feed area of media path 26 is shown in FIGS. 6A and 6B. Once a sensor 36 detects a media jam in the feed area of the paper path 26, processor 40 determines a resolution sequence and activates spatial indicator 38 on the lower side access door 24 adjacent latch 25. This spatially indicates to a user that the first step to be taken is to open the side access door 24 using the latch 25. Once processor 40 detects side access door 24 has been opened (via a door 24 status sensor not-shown), processor 40 then activates a second indicator 38 adjacent the jammed media 35. In this manner, the sequential activation of indicators 38 spatially reflects the steps in the determined resolution sequence to be taken to locate the media jam in media path 26. Once the media jam has been cleared, sensor 36 detects the absence of the jammed media 35. Processor 40, then deactivates each activated indicator 38. For example, the activated indicators may be de-activated once the device is returned to operating condition (e.g., all doors are closed).

Figure 7C:
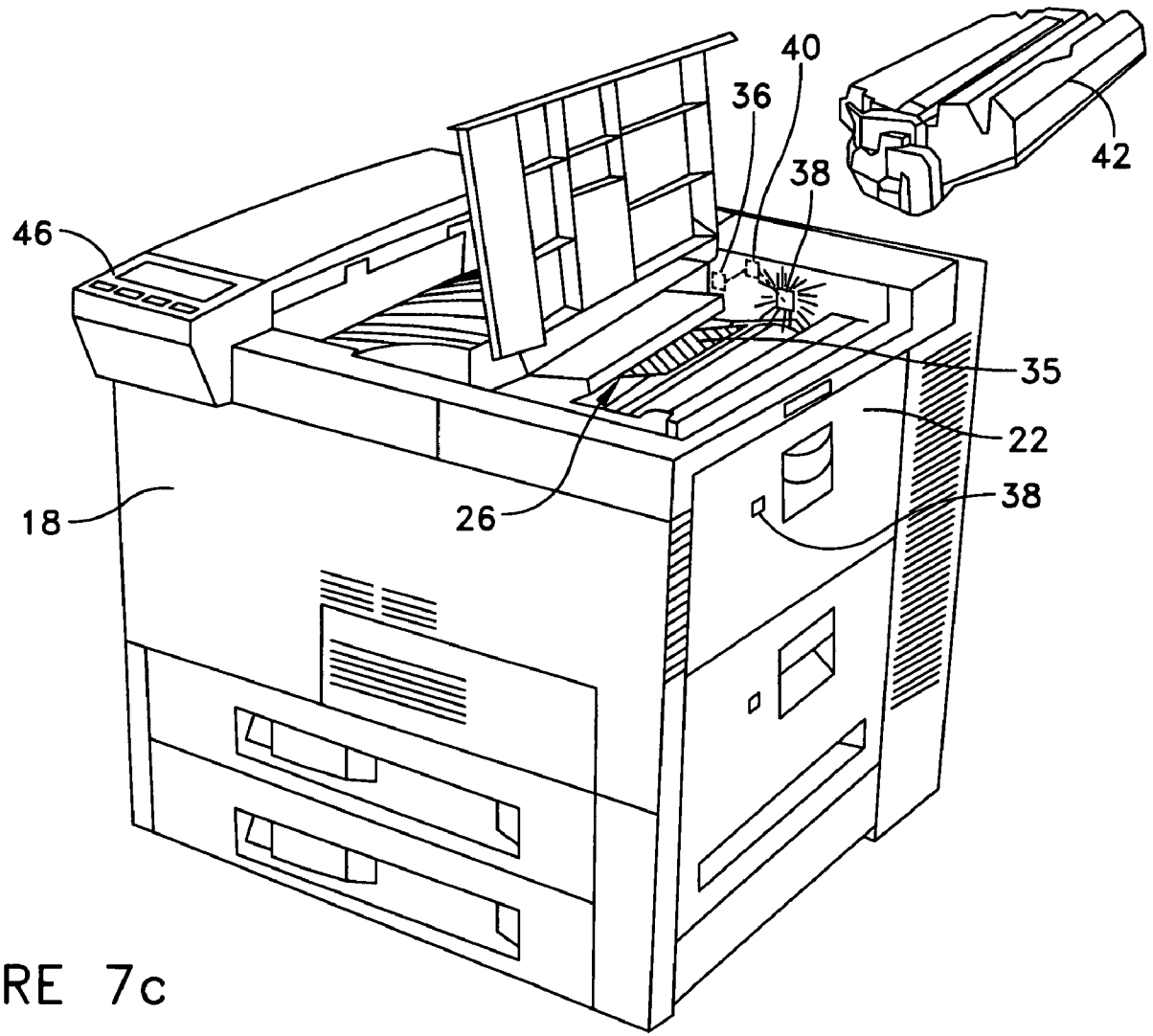
FIG. 7*c* shows a perspective, exploded view of the printing device of FIG. 4*b* indicating the location of the media jam according to an embodiment of the present invention.

An exemplary resolution sequence associated with a media jam in the drum area of media path 26 is shown in FIGS. 7A-7C. A sensor 36 detects the presence of a media jam in the drum area of media path 26. Responsively thereto, processor 40 selectively activates at least one of spatial indicators 38 associated with the location of the detected media jam. In the illustrated case, an indicator 38 adjacent the top access door latch 21 is activated. Upon opening of the latch 21 by a user, processor 40 activates a next indicator 38 in the determined resolution sequence—indicator 38 adjacent toner cartridge 42 in the illustrated case. Upon removal of toner cartridge 42, a next indicator in the sequence is activated—indicator 38 adjacent the location of the jammed media 35 in the illustrated case. Once the media jam has been cleared, a sensor 36 detects the absence of the jammed media 35. Processor 40, in-turn, deactivates any indicators still activated.

According to an embodiment of the present invention, indicators 38 may be deactivated as a successive indicator is activated. Alternatively, once the sensor 36 has detected the location of the media jam and processor 40 has determined a resolution sequence, processor 40 can activate each indicator 38 associated with the determined resolution sequence at one time. However, in such a case a sequence of spatial indications is still provided as a user progresses through the determined resolution sequence.

Accordingly, sequential spatial-type guidance in provided by indicators 38 to help a user more precisely locate media jams that have occurred. The indicators 38 themselves indicate the successive steps to locate the media jam. The indicators 38 themselves indicate which printer component is to be next manipulated to clear the media jam. Additionally, indicators 38 in the vicinity of and preferably adjacent the media path 26, indicate the location of the jammed media 35. This allows a user to quickly identify the location of the media jam and clear it. It further aids the user in detecting multiple media jams.

Video Instruction

Referring again to FIG. 1, printer 10 has at least one user interface 46. In the illustrated embodiment of FIG. 1, user interface 46 takes the form of a control panel. According to an embodiment of the present invention, interface 46 has a visual display 47 that is arranged to reproduce images of users manipulating printer 10, e.g., such as by playing back motion including video. According to an embodiment of the present invention, this visual instruction supports the spatial indicators discussed above and assists users to clear jams in accordance with a determined resolution sequence.

According to an embodiment of the present invention, video clips illustrating user operations are presented using display 47. Display 47 can take various forms of display apparatus, such as liquid crystal or gas discharge display panels, a microdisplay or a cathode-ray tube (CRT) display. Video clips may be spooled from an associated memory and/or streamed or downloaded from a remote memory. For purposes of non-limiting explanation, "spooling", as used herein, generally refers to buffering, such as by putting video clips in a video buffer, memory or on a disk where they can be accessed and played out from. And, "streaming", as used herein, generally refers to a technique for transferring data such that it can be processed as a steady and continuous stream. With streaming, the beginning of a selected video clip may be played out before the entire clip is ready to be played.

Video playback via display 47 occurs when a jam is detected by one or more sensors 36. According to an embodiment of the present invention, a sequence of videos each associated with the determined resolution process is played back. In an embodiment of the present invention, each video played back is also associated with, and illustrates user interaction with, a printer 10 component associated with a then activated spatial indicator 38. For example, in the illustrated case of FIG. 6A, a video clip showing a user finding and manipulating latch 25 may be displayed. Accordingly, video instruction via display 47 supports one or more spatial indicators 38 identified as being associated with a determined jam resolution and that are then being activated by processor 40.

The playback can have selectable levels of detail, e.g., present different levels of detail for a novice user versus a moderately-proficient user, a very experienced user, or even a maintenance technician. Processor 40 can be programmed to determine the level of detail to be displayed, based upon sensed conditions and/or user selections via interface 46. Thus, processor 40 can be programmed to display a summary video clip, with the expectation that the summary will be sufficient, but later display a more detailed video clip if the expected operation does not commence promptly or if user action does not proceed according to an expected sequence of user actions.

Figure 8:
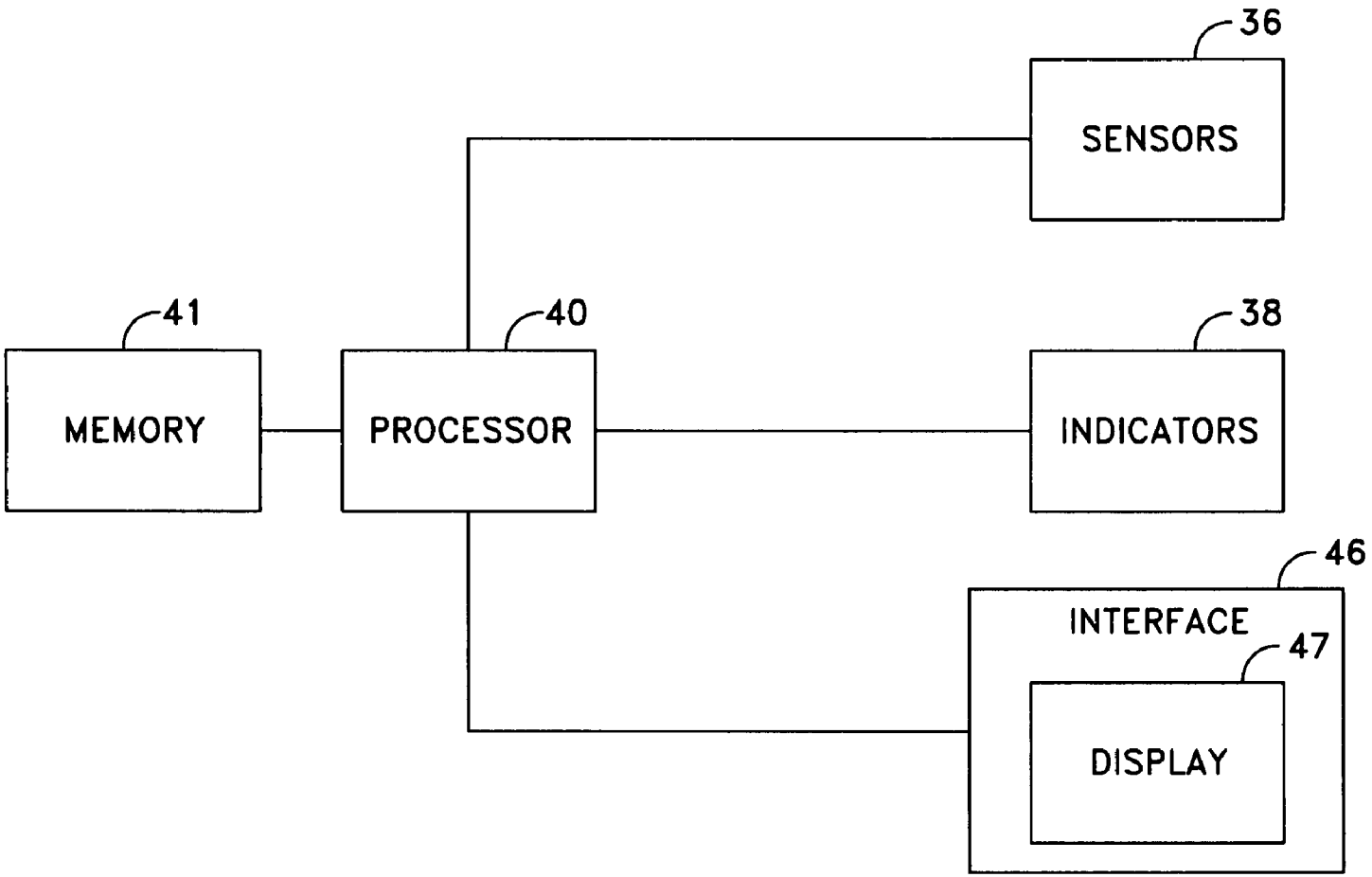
FIG. 8 shows a block diagram of a system suitable for use with the printing device of FIG. 1 according to an embodiment of the present invention.

Referring now to the block diagram of FIG. 8, processor 40 detects a sensor 36 sensed jam condition. Responsively thereto, processor 40 can access memory 41 and determine a resolution sequence. As set forth above, processor 40 then activates one or more indicators 38 responsively to the determined resolution sequence. Processor 40 also selects a sequence of video clips to be displayed. The selected video clips may be spooled or streamed from a memory 41.

According to an embodiment of the invention, memory 41 may be internal and/or external to printer 10 housing 12 (FIG. 1). Where memory 12 is external to printer 10, it may be take the form of the same sort of hardware and software elements that are used in general purpose and desktop computers, such as a computer being operatively coupled to printer 10 via a network. The printer 10 connection to the network can take the form of printer 10 and its processor 40 being addressable units on a local area network (LAN) and/or could involve a Transport Control Protocol/Internet Protocol (TCP/IP) data communication path, for example. For example, printer 10 may be coupled directly or indirectly to a network accessible to the worldwide web (the Internet) such that processor 40 has TCP/IP access. Accordingly, processor 40 may access file transfer protocol (FTP) directories maintained by the printer manufacturer or by a service or an interest group. These files can represent stored video clips. Alternatively, the data communication path may be to a remote Internet site that maintains streaming video programs that can be accessed for playback. Streaming from a remote memory may prove particularly appropriate for clips that are selected for presentation infrequently as compared to other clips. Alternatively, one or more of the files can be downloaded and stored in printer 10 local memory, or a memory housed in a computer operatively coupled to the printer 10.

According to an embodiment of the present invention, each of the video clips contains a demonstration of at least one operation being performed on an exemplary device that at least resembles the subject printer 10. Further, the video clips may demonstrate one or more indicators 38 being activated, as are then occurring on the subject printer 10. The selection of video clips to be played can be made automatically by processor 40 and queued to the display 47, where display 47 includes a video processor. Alternatively, information indicative of the sensor 36 sensed jam(s) may be provided to a general purpose computer operatively coupled to the printer 10, which then sequentially selects and spools or streams videos to display 47. The selection may be based not only on which indicators 38 are then activated, but may also be based on the status of the apparatus as determined by various inputs to processor 40. These inputs may be indicative of the physical parts of printer 10, such as doors being ajar and user selections via interface 46. For example, the user can have the capability to select a programmed level of detail as desired, using interface 46.

The video clips may themselves be of any length and data rate or file size, but in an embodiment of the invention are short and to the point, containing demonstrations of actual operations being conducted on the same sort of device as printer 10. One or more of the video clips may take the form of full-motion video programs streamed from a source or decompressed from a moving pictures experts group (MPEG) audio video interleaved (AVI) movie video file (MOV) or other media format source. One or more of the video clips may take the form of several graphics interchange format (GIF) still images in a series of steps. These can be played back, and/or looped, at a sufficiently fast pace as a brief animation. Other formats may be employed.

Relatively simpler clips can be combined or toggle selectable with more realistic, elaborate, detailed or lengthy illustrations. A simple depiction could show a cartoon animation, or a motion picture clip showing all or part of an artificially generated image. At least certain types of illustrations such as close-ups, advantageously can contain less than a full body image. For hand and finger manipulated printer components, at least an appendage of an exemplary user can be shown in the depicted video, in an act of performing the operation next indicated by the determined resolution sequence.

Figure 9:
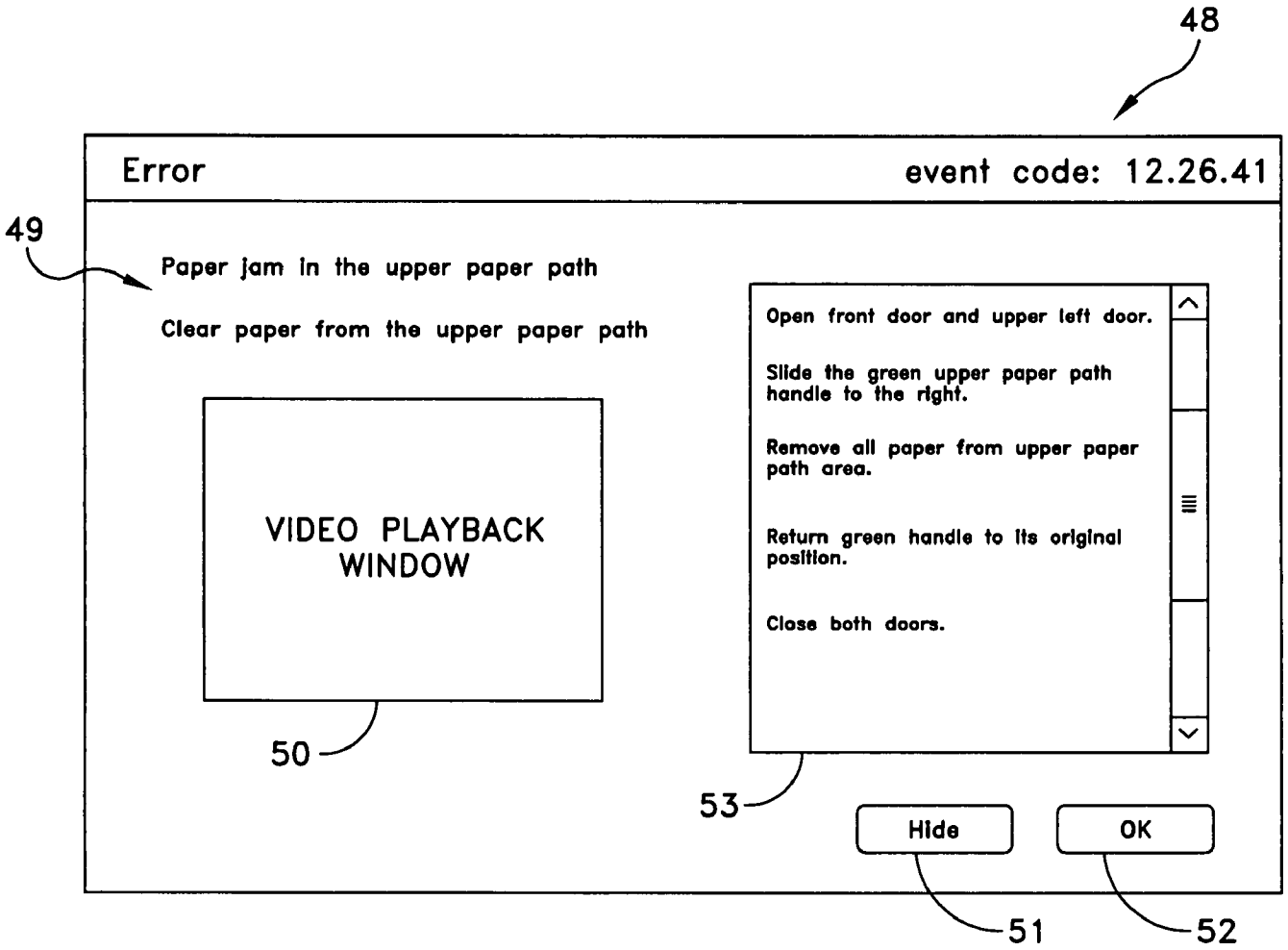
FIG. 9 shows a view of a screen suitable for being displayed on the printing device of FIG. 1 according to an embodiment of the present invention.

Referring now also to FIG. 9, there is shown an exemplary screen 48 that may be presented on display 47 (FIG. 1). In the illustrated case screen 48 includes a video playback area or window 50. Window 50 may take various shapes and sizes, such as being larger or smaller than in the illustrated embodiment. Buttons 51 and 52, in addition to or in lieu of other user interface elements (such as are part of interface 46 of FIG. 1), may be used to change, display or hide other elements of screen 48, such as text instruction window 53. For example, button 51 may be used to selectively hide or display window 53. Button 52 may be used to advance text window 53 to display different textual content. According to an embodiment of the present invention, the size or configuration of window 50 may be altered depending upon whether other display element(s), such as window 53, are then being displayed. By way of further example, when text window 53 is hidden, the size of window 50 may automatically be enlarged to represent a greater portion of display 48.

Text-Based Instruction

Additionally, text-based instruction may be provided either on display 47 (FIG. 1) or another display on or operatively coupled to printer 10 to support the spatial indications. The text may take the form of instructive strings advising the user as to the next step in the determined resolution sequence. Text based instruction provision will be further discussed as it augments the spatial indicators, and determined resolution sequence, discussed with regard to FIGS. 6A and 6B for non-limiting purposes of explanation only. When a sensor 36 detects a media jam in the feed area of the paper path 26, processor 40 activates an indicator 38 on the lower side access door 24 adjacent latch 25. This spatially indicates to a user that the first step to be taken is to open the side access door 24 using latch 25. The first text string presented to the user may be indicative of this resolution step, such as "Open the lower side access door on the right-side of the printer", or "Open the lower side access door as is shown in the video", or "Open the lower side access door next to the blinking arrow." The text strings may be stored in memory 41 (FIG. 8) and selected in an analogous manner as video clips are selected.

Referring again to FIG. 9, screen 48 includes text based content 49 and text based window 53. In the illustrated case, text 49 provides an indication of the type of error that has been detected, and a summary of the corrective action that has been specified by the determined resolution sequence. Window 53 content provides instructive strings advising the user as to the steps in the determined resolution sequence.

Audible Alerts

Figure 10:
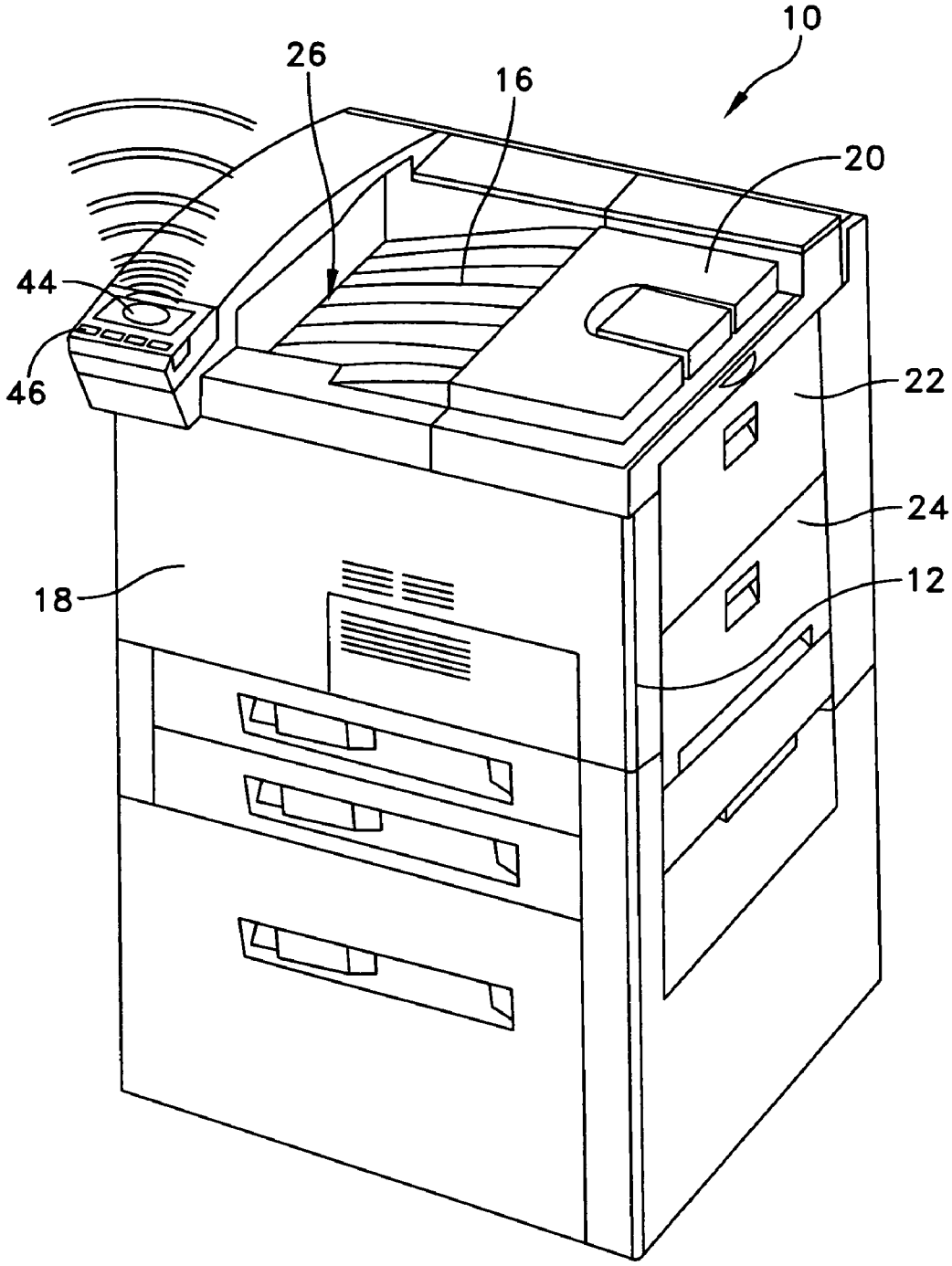
FIG. 10 shows a perspective view of a printing device sounding an audible indicator according to an embodiment of the present invention.

Audible instruction may be used in combination with the visual instruction to support the spatial indications. According to an embodiment of the present invention, two or more types of audible alerts may be provided responsively to user manipulation of parts of a printing device as audible instructions. Referring now to FIG. 10, the audible alerts can be provided by a speaker 44 integrated into the printing device 10, such as interface 46 and/or integrated with a computer communicatively coupled to the printing device. According to an embodiment of the present invention, processor 40 selectively triggers the audible alerts responsively to user interaction with user operable components of printer 10.

The audible alerts will be further discussed as they augment the spatial indicators, and sequential resolution, discussed with regard to FIGS. 6A and 6B for non-limiting purposes of explanation only. Again, when a sensor 36 detects a media jam in the feed area of the paper path 26, processor 40 activates an indicator 38 on the lower side access door 24 adjacent latch 25. This spatially indicates to a user that the first step to be taken is to open the side access door 24 using latch 25. Once the processor detects side access door 24 has been opened, processor 40 then causes a first audible alert to be sounded and activates a second spatial indicator 38 adjacent the jammed media 35. If a user manipulable printer 10 component other than side access door 24 is determined to be manipulated by the user, e.g., the top access door latch 21 is opened, a second audible alert, distinct from the first audible alert is sounded. Once the media jam has been cleared, sensor 36 detects the absence of the jammed media 35. Responsively thereto, processor 40 triggers another generally positive reinforcing audible alert.

According to an embodiment of the present invention, the first audible alert provides generally positive feedback, e.g., is a generally pleasant sound like a ding, ta-da or the like. While the second audible alert provides generally negative feedback, e.g., is a generally unpleasant sound like a buzz, for example. Thus, when a user manipulates the printer component next specified by the jam resolution sequence positive feedback is provided. And, when a user manipulates a printer component other than that next specified by the jam resolution sequence negative feedback is provided.

Alternatively, or in addition thereto, the audible indication (s) may also correspond to the instructions provided in window 53 (FIG. 9), such as by essentially announcing the textual strings to a user.

Accordingly, audible alerts indicative of a determined resolution sequence for a detected jam are provided. And, the sequential activation of audible alerts audibly reflects user compliance with the determined resolution sequence for locating and clearing the media jam in media path 26.

Resolution Sequence Determination and Implementation

Figure 11:
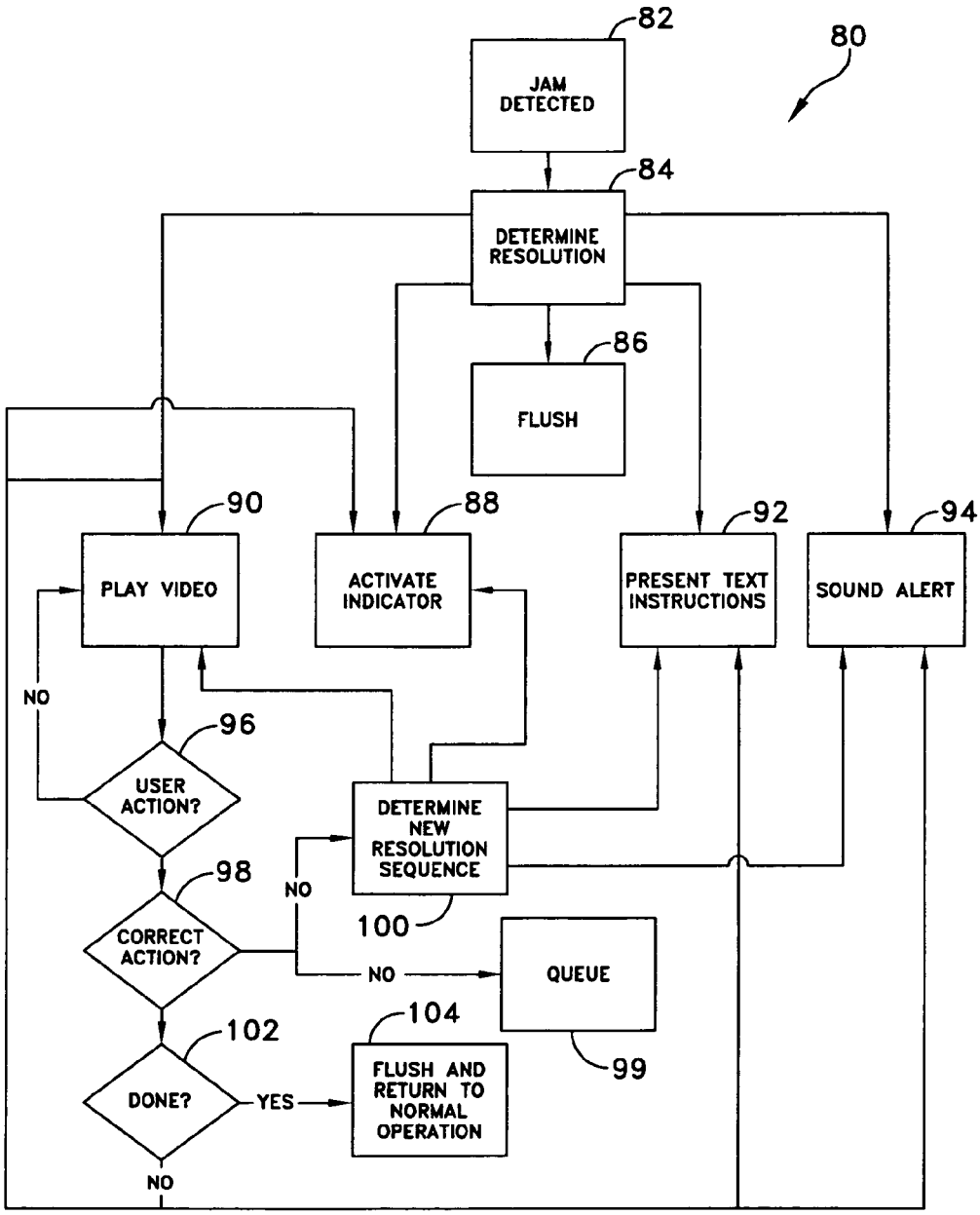
FIG. 11 shows a block diagram of a process according to an embodiment of the present invention.

Sensors 36 detect media as it progresses along media path 26. Timing may be used to establish when media is expected to be delivered from one portion to another portion of path 26. Sensors 36 may detect this delivery. When media is not delivered as expected, a jam condition may be determined to exist, such as by processor 40. Referring now to FIG. 11, there is shown a resolution sequence or process 80. Process 80 commences with a jam being detected at block 82. At block 84, a resolution sequence or procedure is determined. The resolution sequence may be determined by processor 40 or a general purpose computer operatively coupled to processor 40. Alternatively, where the printer 10 is coupled directly or indirectly to a network accessible to the worldwide web (the Internet) and processor 40 has TCP/IP access to one or more servers maintained by the printer manufacturer or by a service or an interest group, the jam indication may be provided to a server, and the resolution sequence provided thereby to the processor 40. "Server", as used herein, generally refers to a computing device, connected to a network and that manages network resources. A server may be a dedicated collection of computing hardware and/or software components, meaning that they perform no other tasks besides their server tasks, or may refer to hardware and/or software components that are managing resources rather than the entire computing device. A server generally includes, and/or uses, a processor.

The resolution sequence or process may be determined by identifying which sensor(s) a detected jam is associated with, and identifying a predefined resolution sequence or process associated with the identified sensor(s). For example, in the illustrated case of FIG. 2, there are five sensors 36. A resolution sequence for each of the five sensors may be stored, such as within memory 41 (FIG. 8). Upon detecting a jam associated with one of the five sensors, the corresponding resolution sequence may be determined and recovered from memory 41 by processor 40.

Responsively thereto, media in path 26 downstream from the detected jam is flushed to the finisher or output tray at block 86, e.g., out of path 26. At block 88 a spatial indicator 38 (FIG. 1) associated with a first step in the determined resolution sequence is activated. At block 88, a first video clip associated with the first step in the determined resolution sequence is played out. At block 92 textual instructions associated with the determined resolution sequence are presented. At block 94, an audible alert associated with the determined resolution sequence is sounded. According to an embodiment of the invention, the video clip, the textual instruction and the audible alert each communicate a common determined resolution procedure. According to an embodiment of the present invention, the played video clip shows a user finding the activated spatial indicator and manipulating the printer 10 component associated with the activated indicator in accordance with the presented text instructions. At block 96, it is determined whether a user has yet manipulated a printer 10 component. According to an embodiment of the present invention, the played video clip may be looped until a user interacts with printer 10, such as by opening a door thereof.

When a user manipulation of a printer 10 component is sensed, e.g., a printer 10 door is opened, it is determined whether the correct user manipulable component, e.g., the component associated with the activated spatial indicator, has been manipulated at block 98. If the correct action was not taken, the resolution sequence is updated to remedy or reverse the incorrect action taken by the user at block 100. This may involve processor 40 looking up a resolution sequence for reversing the incorrect action and inserting the steps of that sequence prior to the steps of the sequence determined at block 84. Responsively thereto, the video clip, activated indicators, text instructions and sound alerts at blocks 88, 90, 92 and 94 are all updated. For example, at block 88, a clip of a user reversing the incorrect action may be retrieved and played out. At block 90, an indicator associated with an incorrectly manipulated component may be activated. At block 92, the textual instructions may be updated to reverse the incorrect action. And, at block 94 a negative reinforcement tone may be sounded to indicate an incorrect action was taken. The new resolution sequence determined at block 100 may include clearing media pages in areas of printer 10 improperly accessed and reverse manipulating the printer 10 component improperly manipulated by the user.

Alternatively, if it is determined that an improper action was taken at block 98, the resulting condition can be queued as a separate jam for analogous resolution, either before or after prior jam(s) are clearing. In such a case, printer components that were improperly manipulated by the user may be tracked. After the jam has been cleared, the user may be prompted (via processing analogous to that described with regard to blocks 88, 90, 92, 94, 96, 98) to remove any media pages in the printer 10 areas improperly accessed.

Where a correct user action is determined to have taken place at block 98, it is determined whether there are any more steps to be taken in the determined resolution at block 102. If there are no additional steps, media pages upstream from the sensed jam are flushed through path 26 to the finisher or bin and printer 10 returns to normal operation at block 104. For example, a pending job may be recalculated back to the last good page, e.g., the last page before the jam, such that job processing may continue.

If there are additional steps to be taken in the determined resolution, the next step in the determined resolution is used and processing returns to blocks 88, 90, 92, 94, where a next video is played, a next indicator is activated, the instruction text may be updated, or automatically scrolled through, and another available indicator may be sounded.

According to an embodiment of the invention, the blocks are iteratively repeated for until the jam has been cleared and all user manipulated components have been returned to their normal operating state or condition. In this way, a user is guided through clearing a jam and provided with positive and negative feedback regarding their actions as taken.

In some instances, a media jam may occur at more than one location along media path 26. When this occurs, multiple sensors 36 detect media jams at multiple locations. According to an embodiment of the present invention, in such a case processor 40 operates to clear a first of the media jams, and upon clearing of the first media jam, to clear any successive media jams. Once all media jams have been cleared all indicators may be de-activated.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for assisting a user to clear a media jam in a printing device that announces pages, picks media responsively to the announced pages and images the picked media using a media path, said method comprising:

detecting a media jam at a given location along the media path;

halting printing device components upstream from the given location in the media path while continuing to image picked media downstream from the given location in the media path;

prompting the user to clear the detected media jam from the given location after all downstream media has been imaged;

flushing any picked media upstream from the given location in the media path after the media jam at the given location has been cleared; and, re-announcing pages corresponding to the flushed media.

2. The method of claim 1, further comprising, in predetermined situations, un-announcing any pages not having media picked responsively thereto.

3. The method of claim 2, further comprising re-announcing the unannounced pages.

4. The method of claim 3, further comprising re-announcing pages corresponding to media that was upstream of the given location in the media path when the jam was detected.

5. The method of claim 4, further comprising re-announcing a page corresponding to the media that was at the given location in the media path when the jam was detected.

6. The method of claim 1, wherein the prompting comprises:

providing text-based instructions associated with the detected jam;

providing video-based instructions associated with the detected jam; and, activating visual indicators corresponding to select parts of the printing device associated with the detected jam;

wherein the text based instructions and video-based instructions are each activated to communicate a common resolution procedure for the detected jam.

7. A printing device comprising:

an engine for imaging media;

an output device adapted to receive and deliver imaged media from the engine, wherein the engine and output device provide a media path through the device;

a formatter operatively coupled to the engine and output device;

means for detecting a media jam at a given location along the media path;

means for halting printing device components upstream from the given location in the media path while continuing to image media downstream from the given location in the media path;

means for prompting the user to clear the detected media jam from the given location after all downstream media has been imaged;

means for flushing any nicked media upstream from the given location in the media path after the media jam at the given location has been cleared; and, means for re-announcing pages corresponding to the flushed media.

8. The printing device of claim 7, further comprising:

means for announcing pages means for picking media for imaging responsively to the announced pages, means for unannouncing any pages not having media picked responsively thereto;

means for flushing any picked media upstream from the given location in the media path after the media jam at the given location has been cleared;

means for re-announcing pages corresponding to the flushed media and unannounced pages.

9. The printing device of claim 7, wherein the means for prompting the user to clear the detected media jam from the given location after all downstream media has been imaged comprises firmware in the formatter.

10. The printing device of claim 9, wherein the means for halting printing device components upstream from the given location in the media path while continuing to image media downstream from the given location in the media path comprises firmware in at least one of the engine and output device.

11. The printing device of claim 10, wherein the means for detecting a media jam at a given location along the media path comprises firmware in at least one of the engine and output device.

12. The printing device of claim 7, further comprising:

means for providing text-based instructions associated with the detected jam;

means for providing video-based instructions associated with the detected jam; and, means for activating visual indicators corresponding to select parts of the printing device associated with the detected jam;

wherein the text based instructions and video-based instructions are each activated to communicate a common resolution procedure for the detected jam.

13. A printing device comprising:

an engine for imaging media;

an output device operatively coupled to receive and deliver imaged media from the engine, wherein the engine and output device provide a media path through the device;

a formatter operatively coupled to the engine and output device;

means for sensing user manipulation of the engine and the output device:

means for sounding a first audible alert when the sensed manipulation is associated with an activated visual indicator;

means for sounding a second audible alert when the manipulated component is associated with an un-activated visual indicator;

means for detecting a media jam at a given location along the media path;

means for halting engine and output device components upstream from the given location in the media path while continuing to image and deliver media downstream from the given location in the media path; and, means for prompting the user to clear the detected media jam from the given location after all downstream media has been imaged.

14. The printing device of claim 13, wherein the engine, output device and formatter are further configured to cooperatively announce pages and pick media responsively to the announced pages and un-announce any pages not having media picked responsively thereto.

15. The printing device of claim 13, wherein the engine, output device and formatter are further configured to cooperatively announce pages and pick media responsively to the announced pages and re-announce the unannounced pages.

16. The printing device of claim 13, wherein the engine, output device and formatter are further configured to cooperatively announce pages and pick media responsively to the announced pages and re-announce pages corresponding to media that was upstream of the given location in the media path when the jam was detected.

17. The printing device of claim 16, wherein the engine, output device and formatter are further configured to cooperatively re-announce a page corresponding to the media that was at the given location in the media path when the jam was detected.

18. The printing device of claim 17, wherein the engine, output device and formatter are further configured to cooperatively:

flush any picked media upstream from the given location in the media path after the media jam at the given location has been cleared; and, re-announce pages corresponding to the flushed media.

* * * * *

UNITED STATES PATENT AND TRADEMARK OFFICE

CERTIFICATE OF CORRECTION

PATENT NO. : 7,484,731 B2
APPLICATION NO. : 11/510919
DATED : February 3, 2009
INVENTOR(S) : Hernan Ildefonso Gutierrez-Vazquez et al.

It is certified that error appears in the above-identified patent and that said Letters Patent is hereby corrected as shown below:

On the title page, item (75), in "Inventors", in column 1, line 2, delete "Boxde" and insert -- Boise --, therefor.

In column 14, line 15, in Claim 7, delete "nicked" and insert -- picked --, therefor.

In column 14, line 64, in Claim 13, after "device" delete ":" and insert -- ; --, therefor.

Signed and Sealed this

Twenty-sixth Day of May, 2009

JOHN DOLL
*Acting Director of the United States Patent and Trademark Office*